US006059654A

United States Patent [19]

Kim

[11] Patent Number: 6,059,654

[45] Date of Patent: May 9, 2000

[54] DISCHARGE GRILL OF AN AIR CONDITIONER

[75] Inventor: Jae-Soon Kim, Suwon, Rep. of Korea

[73] Assignee: SamSung Electronics Co., Ltd., Kyungki-do, Rep. of Korea

[21] Appl. No.: 09/243,687

[22] Filed: Feb. 3, 1999

[30] Foreign Application Priority Data

Jan. 14, 1999 [KR] Rep. of Korea ..... P99-753

[51] Int. Cl.[7] ..... E06B 7/02

[52] U.S. Cl. ..... 454/202; 454/315; 454/320

[58] Field of Search ..... 454/202, 313, 454/315, 319, 320, 321, 155, 109

[56] References Cited

U.S. PATENT DOCUMENTS

| | | | |
|---|---|---|---|
| 4,018,159 | 4/1977 | Bennett | 454/315 |
| 4,414,170 | 11/1983 | Sano | 454/155 |
| 4,499,816 | 2/1985 | Bolton et al. | 454/202 |
| 4,546,695 | 10/1985 | Ouchi et al. | 454/155 |
| 4,699,322 | 10/1987 | Jobst | 454/155 |
| 4,905,580 | 3/1990 | Komori et al. | 454/315 |
| 5,393,262 | 2/1995 | Hashimoto et al. | 454/155 |
| 5,766,070 | 6/1998 | Schwartz | 454/155 |

FOREIGN PATENT DOCUMENTS

| | | | |
|---|---|---|---|
| 0397909 | 11/1990 | European Pat. Off. | 454/155 |

*Primary Examiner*—Denise L. Ferensic
*Assistant Examiner*—Alein Cadalso
*Attorney, Agent, or Firm*—Robert E. Bushnell, Esq.

[57] ABSTRACT

A discharge grill of an air conditioner is capable of preventing the discharge port from being blocked by the rotation of horizontal blades. The discharge grill comprises a frame which is fixed into a discharge port of an air conditioner, a rightward/leftward air direction adjusting means having a plurality of vertical blades which are disposed on the frame in a perpendicular relation with the upper/lower walls of the frame to be rotated rightward/leftward, an upward/downward air direction adjusting means having a plurality of horizontal blades which are disposed on the frame in a horizontal relation with the upper/lower walls of the frame to be rotated upward/downward, and the rotational movement limiting means for limiting a rotational movement of the horizontal blades when the horizontal blades are rotated upward/downward. The rotational movement limiting means comprises an inclined section which is formed on at least one sidewall of the frame in a perpendicular relation to the upper/lower walls of the frame, and an interference section extending from the horizontal blades to correspond with the inclined section of the frame. The interference section functions to stop the rotational movement of the horizontal blades by coming to an intervening position with the inclined section when the horizontal blades are rotated upward/downward to a predetermined degree. Accordingly, the degree of rotational movement of the horizontal blades upward/downward is limited.

5 Claims, 7 Drawing Sheets

DISCHARGE GRILL OF AN AIR CONDITIONER

BACKGROUND OF THE INVENTION

1. Field of the Invention

The present invention relates to an air conditioner, and more particularly to a discharge grill of an air conditioner which is fixed in a discharge port of the air conditioner to adjust a direction of air which is discharged therethrough.

2. Description of the Prior Art

Generally, an air conditioner operates to adjust temperature and humidity of the room at an appropriate degree by means of its refrigerating cycle which is composed of a compressor, a condenser, an expansion valve, and an evaporator. Such an air conditioner has a suction port through which the air of the room is sucked into the air conditioner, and a discharge port through which the cooled/heated air (hereinafter collectively referred to as the "air") is discharged into the room.

As shown in FIG. 1, a suction grill 1 and a discharge grill 2 are fixed in the suction port and the discharge port, respectively. The suction grill 1 generally has a crossed, or barred shapes. The discharge grill 2 has a rather complex structure in comparison with the suction grill 1, in order to adjust the discharging direction of the air.

As shown in FIG. 2, such a discharge grill 2 has a frame 22, a plurality of horizontal blades 24 horizontally disposed to the frame 22, and a plurality of vertical blades 26 disposed at the rear of the horizontal blades 24 in a perpendicular relation to the horizontal blades 24.

Since the horizontal blades 24 are connected to each other by a vertical connector 25, all the horizontal blades 24 are rotated upwardly/downwardly at once. Also, the vertical blades 26 which are connected to each other by a horizontal connector 27, are rotated rightward/leftward all at once.

More specifically, each of the horizontal blades 24 is rotatably disposed on the frame 22 upward/downward, by first rotary shafts 24*a* and 24*b* which are inserted into first shaft holes 22*a* and 22*b* of the frame 22. Here, the first rotary shafts 24*a* and 24*b* protrude from both sides of each of the horizontal blades 24, and the first shaft holes 22*a* and 22*b* are formed on both inner sidewalls of the frame 22. The vertical connector 25 connects first connecting sections 24*c* which are formed at respective left or right sides of the horizontal blades 24. Cutaway sections 24*d* are formed near to the first connecting sections 24*c* of the horizontal blades 24, respectively. Due to the presence of the cutaway sections 24*c*, the horizontal blades 24 are rotated, simultaneously. As shown in FIG. 3, a predetermined clearance (Y) is defined between the vertical connector 25 and each of the cutaway sections 24*d*. Additionally, spacers 24*e* having a predetermined thickness (X) are disposed around the rotary shafts 24*a* and 24*b* of each of the horizontal blades 24, so that the horizontal blades 24 maintain a predetermined distance (X) from both inner sidewalls of the frame 22. Accordingly, both sides of each of the horizontal blades 24 do not interfere with both inner sidewalls of the frame 22 when the horizontal blades 24 are rotated.

Meanwhile, each of the vertical blades 26 is disposed on the upper and lower walls of the frame 22 to be rotated rightward/leftward, by a pair of second rotary shafts 26*a* and 26*b* which are inserted into second shaft holes 22*c* and 22*d* of the frame 22. Here, the second rotary shafts 26*a* and 26*b* are formed on the upper and lower ends of each of the vertical blades 26, and the shaft holes 22*c* and 22*d* are formed on the upper and the lower walls of the frame 22. Further, the horizontal connector 27 connects second connecting sections 26*c* which are formed at the lower sides of the vertical blades 26, respectively.

Accordingly, when the air is discharged to the room, the horizontal and vertical blades 24 and 26 are rotated upward/downward and rightward/leftward, so that the discharging direction of the air is adjusted upward/downward and rightward/leftward.

Here, the vertical blades 26 are usually rotated by a motor (not shown), while the horizontal blades 24 are rotated by the user, manually.

Accordingly, a problem arises when the user manually rotates the horizontal blades 24 to adjust the direction of the discharged air upward/downward. That is, the user may rotate the horizontal blades 24 to an extreme extent, so that the horizontal blades 24 may block the discharge port through which the air is discharged. Accordingly, resistance occurs in the discharge port while the air is discharged therethrough, and the air discharge performance is deteriorated. Further, the load becomes heavier. Accordingly, the degree of rotating the horizontal blades 24 needs to be controlled, appropriately.

For the above purpose, cutaway sections 24*d* are defined at the first connecting sections 24*c* of the horizontal blades 24, respectively. The predetermined clearances Y are defined between the cutaway sections 24*d* and the vertical connector 25, respectively so that the horizontal blades 24 are rotated upward/downward in the predetermined limit of movement.

More specifically, as shown in FIG. 4A, when the user rotates the horizontal blades 24 upward/downward, the horizontal blades 24 are rotated about the rotary shafts 24*a* and 24*b*. As the horizontal blades 24 are rotated upward/downward, the clearances Y between the ends of the respective cutaway sections 24*d* and the vertical connector 25 decrease, and the ends of the cutaway sections 24*d* of the horizontal blades 24 finally come in contact with the vertical connector 25, so that the horizontal blades 24 are not rotated further. Thus, the possibility that the discharge port of the air conditioner may be blocked, is prevented, by the above-described structure and operation in which the horizontal blades 24 are rotated upward/downward in the predetermined limit.

In the conventional discharge grill of the air conditioner which has been described as above, however, a separate structure has to be employed to limit the upward/downward rotational movement of the horizontal blades 24. That is, the vertical connector 25 to which the sides of the respective horizontal blades 24 are connected, has to be employed. Further, the cutaway sections 24*d* have to be defined at the horizontal blades 24, respectively, at the places that correspond with the vertical connector 25.

Further, the conventional discharge grill of the air conditioner requires the spacers to be disposed between both sides of the horizontal blades 24 and both inner sidewalls of the frame 22, and accordingly, the clearances are defined between both sides of the horizontal blades 24 and the frame 22 so that the air conditioner has a less neat appearance.

SUMMARY OF THE INVENTION

The present invention has been developed to overcome the above-described problems of the prior art, and accordingly, it is an object of the present invention to provide a discharge grill of an air conditioner which is capable of limiting the degree of upward/downward rotational movement of the horizontal blades by means of a simple structure which is the simple variation of the shape of the horizontal blades.

Another object of the present invention is to provide a discharge grill of an air conditioner which provides a neater appearance to the air conditioner by having a structure in which spaces defined between the horizontal blades and both sidewalls of the frame are not exposed.

The above-described objects of the present invention are accomplished by a discharge grill of an air conditioner according to the present invention comprising a frame, a rightward/leftward direction adjusting section, an upward/downward direction adjusting section, and a rotational movement limiting section. Here, the frame is fixed into a discharge port of the air conditioner. The rightward/leftward direction adjusting section comprises a plurality of vertical blades which are disposed on the frame in a perpendicular relation to upper/lower walls of the frame, to be rotated leftward/rightward. The upward/downward direction adjusting section comprises a plurality of horizontal blades which are disposed on the frame in a horizontal relation to the upper/lower walls of the frame, to be rotated upward/downward. The rotational movement limiting section limits the upward/downward rotational movement of the horizontal blades.

Here, the rotational movement limiting section comprises an inclined section, and an interference section. The inclined section is formed on at least one sidewall of the frame, in a perpendicular relation to the upper/lower walls of the frame. The interference section extends from the horizontal blades to correspond with the inclined section of the frame. While the horizontal blades are rotated upward/downward, the interference section comes to an intervening position with the inclined section of the frame to stop the further rotational movement of the horizontal blades. Accordingly, the degree of rotational movement of the horizontal blades is limited.

As described above, according to the present invention, the simple variation of the horizontal blades in shapes can limit the degree of upward/downward rotational movement of the horizontal blades. Thus, no additional and separate devices for limiting the degree of rotational movement of the horizontal blades are required.

Further, in the discharge grill according to the present invention, since the interference sections extending from both sides of each of the horizontal blades block the spaces which are defined between both sides of the horizontal blades and both sidewalls of the frame, the appearance of the air conditioner is improved.

BRIEF DESCRIPTION OF THE DRAWINGS

The above objects and advantages will be more apparent by describing the present invention with reference to the accompanied reference drawings, in which.

DETAILED DESCRIPTION OF THE PREFERRED EMBODIMENT

Figure 1:
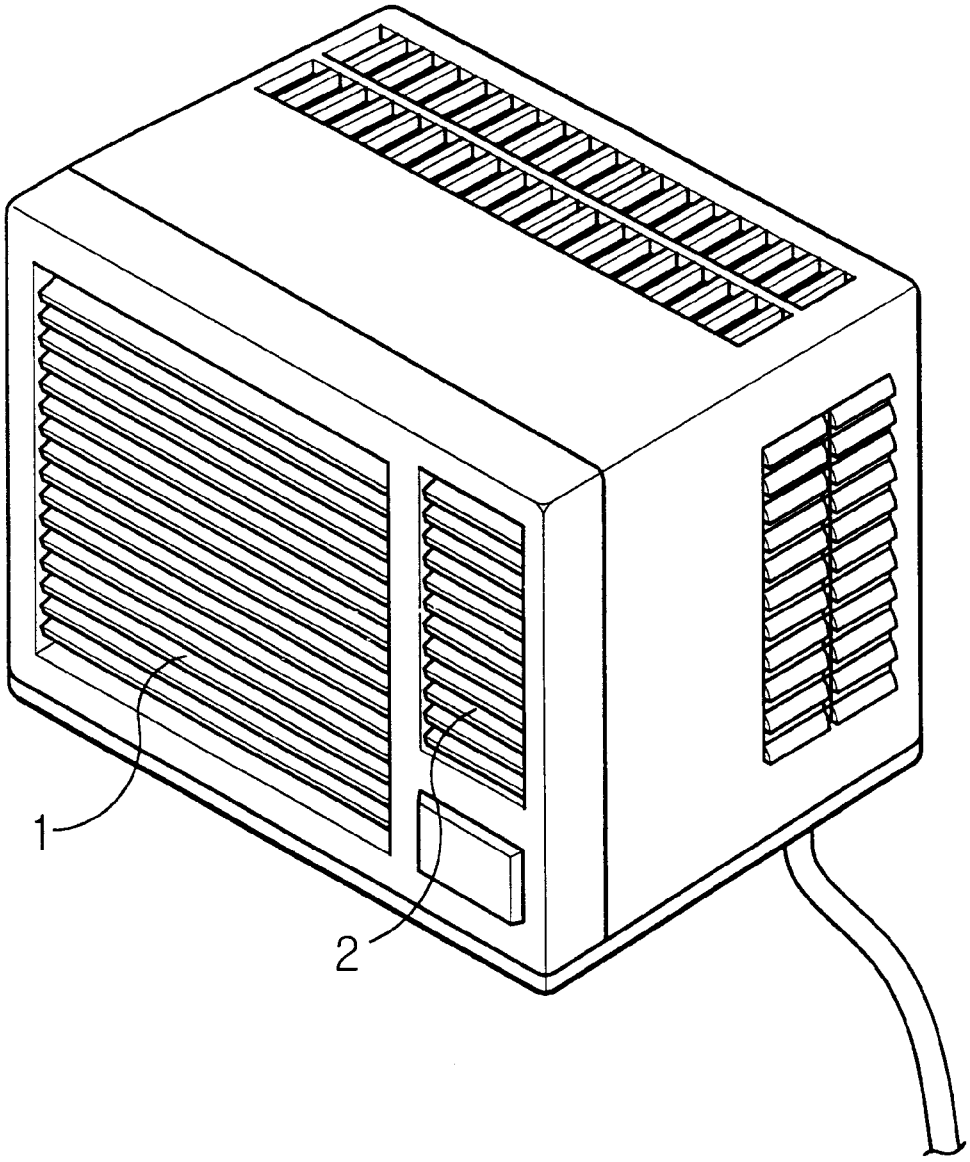
FIG. 1 (PRIOR ART)
FIG. 1 is a perspective view of a conventional window-mounted type air conditioner.
Figure 2:
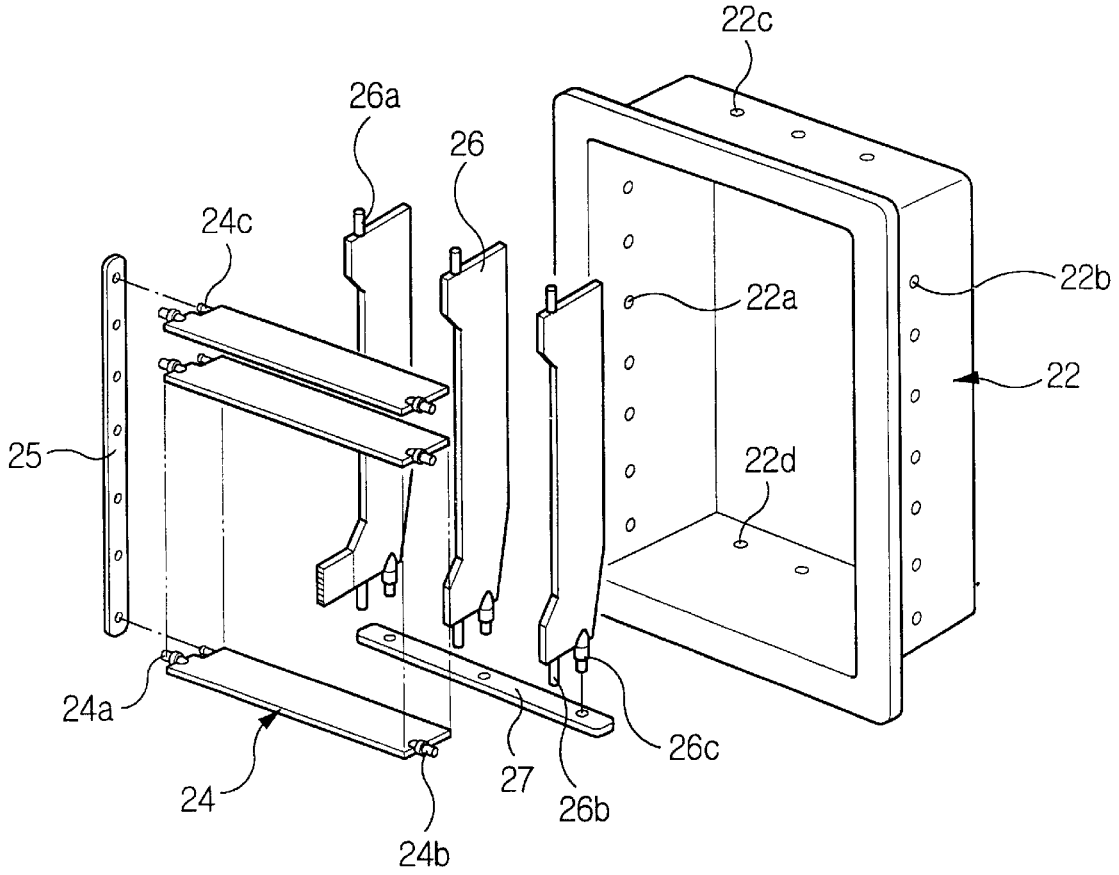
FIG.2 (PRIOR ART)
FIG. 2 is an exploded perspective view of a discharge grill of the window-mounted type air conditioner which is shown in FIG. 1.
Figure 3:
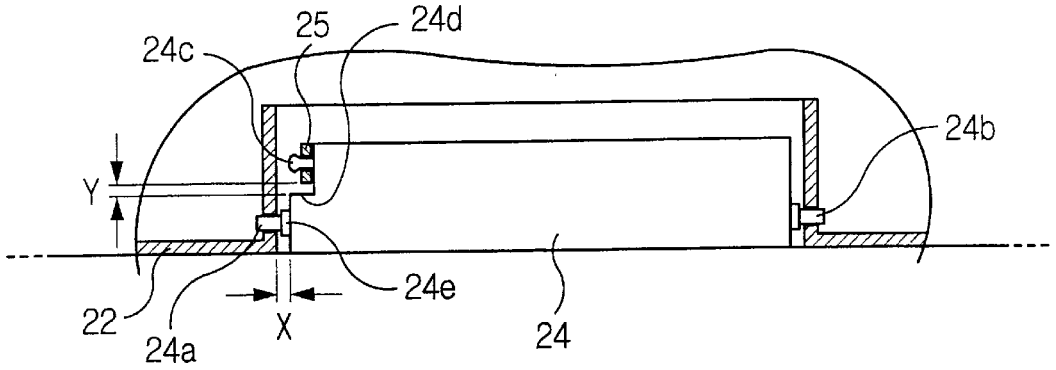
FIG.3 (PRIOR ART)
FIG. 3 is a sectional view for showing the main part of horizontal blades which are disposed in the discharge grill shown in FIG. 2.
Figure 4A:
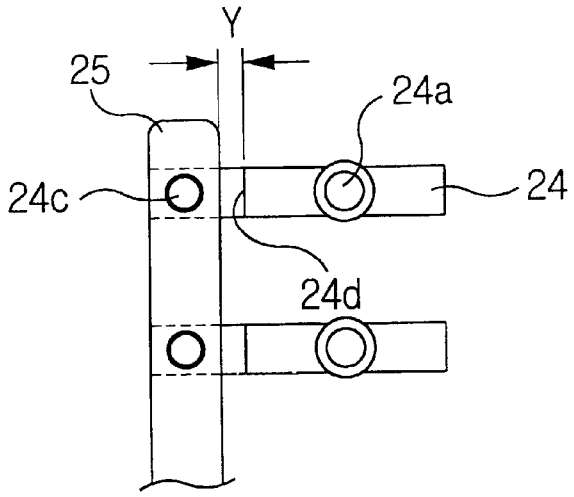
FIG.4A (PRIOR ART)
FIGS. 4A and 4B are views for illustrating the operation of the horizontal blade rotational movement limiting section which is employed in the conventional discharge grill.
Figure 4B:
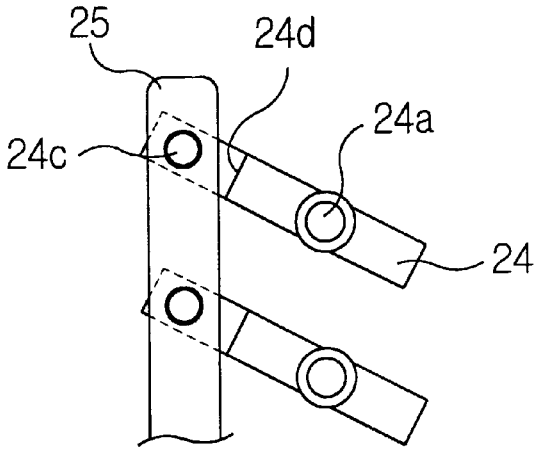
FIG.4B (PRIOR ART)
Figure 5:
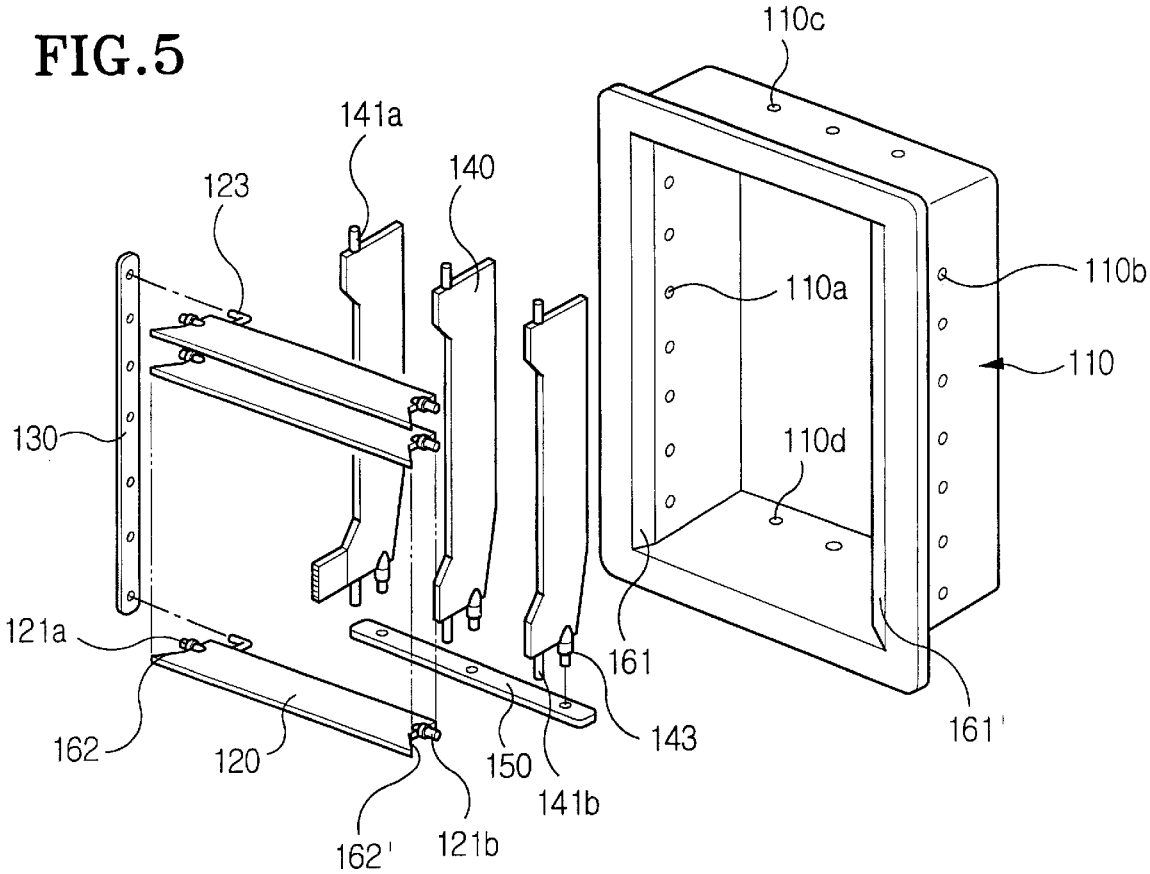
FIG. 5 is an exploded perspective view of a discharge grill of an air conditioner according to a first preferred embodiment of the present invention.

FIG. 5 shows a discharge grill according to the first preferred embodiment of the present invention. As shown in FIG. 5, the discharge grill comprises a frame 110, a plurality of horizontal blades 120 which are disposed on the frame 110 in a horizontal relation to upper/lower walls of the frame 120, a plurality of vertical blades 140 which are arranged behind the horizontal blades 120 in a perpendicular relation to the horizontal blades 120, and a limiting means for limiting the upward/downward rotational movement of the horizontal blades 120.

The frame 110 has a rectangular shape, and is fixed in a discharge port (not shown) of an air conditioner. A plurality of first shaft holes 110*a* and 110*b* are formed on both sidewalls of the frame 110, while spaced from each other at a predetermined distance. A plurality of second shaft holes 110*c* and 110*d* which have the same structure with the first shaft holes 110*a* and 110*b* are formed on the upper/lower walls of the frame 110.

Figure 6:
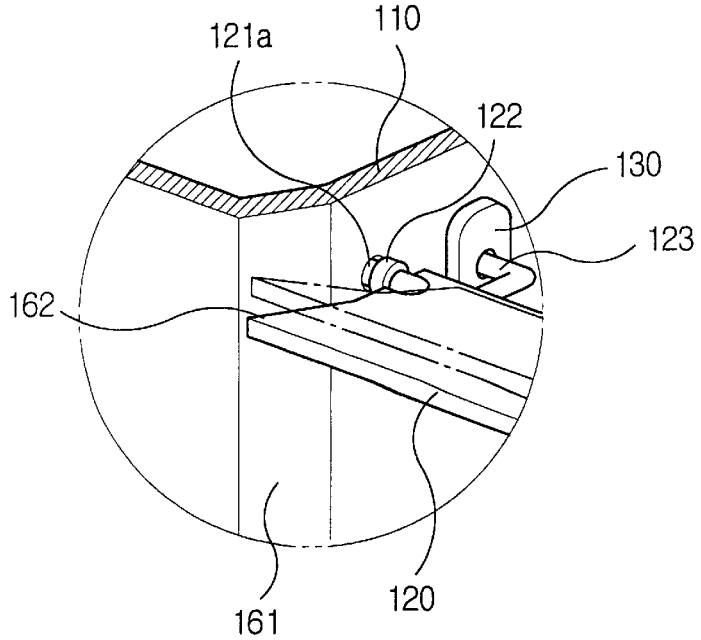
FIG. 6 is a perspective view for illustrating the operation of the horizontal blades of the discharge grill (shown in FIG. 5) in greater detail.

As shown in FIG. 6, each of the horizontal blades 120 has a pair of first rotary shafts 121*a* and 121*b* protruding from both sides thereof Thus, as the first rotary shafts 121*a* and 121*b* are inserted into the first shaft holes 110*a* and 110*b* of the frame 110, the horizontal blades 120 are disposed on the frame 110, to be rotated upward/downward. Further, spacers 122 are disposed around the first rotary shafts 121*a* and 121*b*, to maintain a predetermined distance between both sides of each of the horizontal blades 120 and both sidewalls of the frame 110. Also, first connecting sections 123 are disposed at respective rear sides of the horizontal blades 120, to be connected to each other by a vertical connector 130. Accordingly, the horizontal blades 120 are rotated, simultaneously.

Each of the vertical blades 140 is rotatably disposed on the frame 110 by a pair of second rotary shafts 141*a* and 141*b* which protrude from the upper and lower ends of each of the vertical blades 140. Accordingly, as the second rotary shafts 141*a* and 141*b* are inserted into second shaft holes 110*c* and 110*d* of the frame 110, the vertical blades 140 can be rotated rightward/leftward. Second connecting sections 143 are disposed at respective lower sides of the vertical blades 140, to be connected to each other by a horizontal connector 150. Thus, the vertical blades 140 are rotated, simultaneously. Here, the vertical blades 140 are rotated rightward/leftward by a driving motor (not shown).

The limiting means has inclined sections 161 and 161', and interference sections 162 and 162'. The inclined sections 161 and 161' are formed on both sidewalls of the frame 110 in a perpendicular relation to the upper/lower walls of the frame 110, and the interference sections 162 and 162' extend from both sides of each of the horizontal blades 120 to correspond with the inclined sections 161 and 161'. Here, when the horizontal blades 120 are rotated upward/downward at a predetermined degree, the interference sections 162 and 162' stop the rotational movement of the horizontal blades 120 by coming to an intervening position with the inclined sections 161 and 161' of the frame 110. Accordingly, the horizontal blades 120 are not rotated further once the horizontal blades 120 are rotated to the predetermined extent. As described above, the upward/downward rotational movement of the horizontal blades 120 is limited.

Figure 7A:
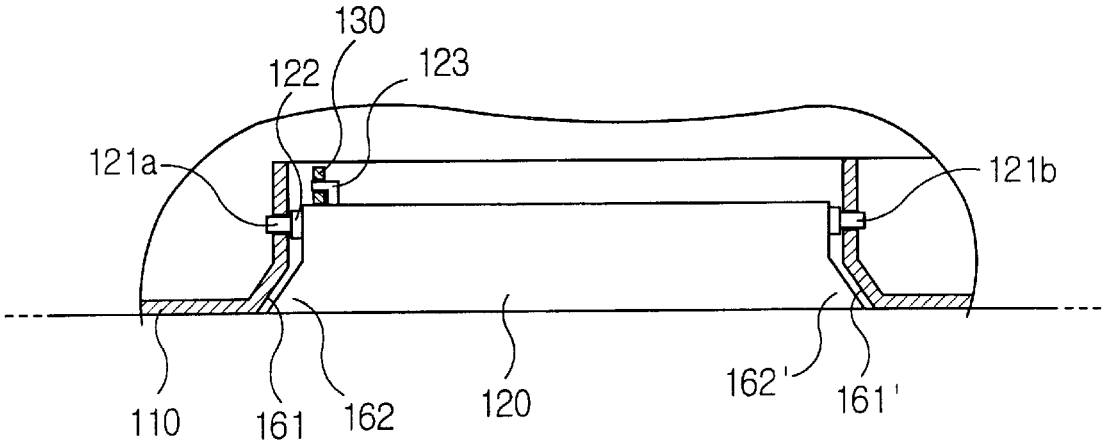
FIG. 7A is a plan sectional view of FIG. 5, in which the horizontal blades are on a horizontal plane.

In the discharge grill according to the present invention, the horizontal blades 120 are enabled to be rotated upward/downward as long as the horizontal blades 120 are in a state which is shown in FIG. 6 (in a solid line) and FIG. 7A, in which the interference sections 162 and 162' of the horizontal blades 120 and the inclined sections 161 and 161' do not interfere with each other.

Figure 7B:
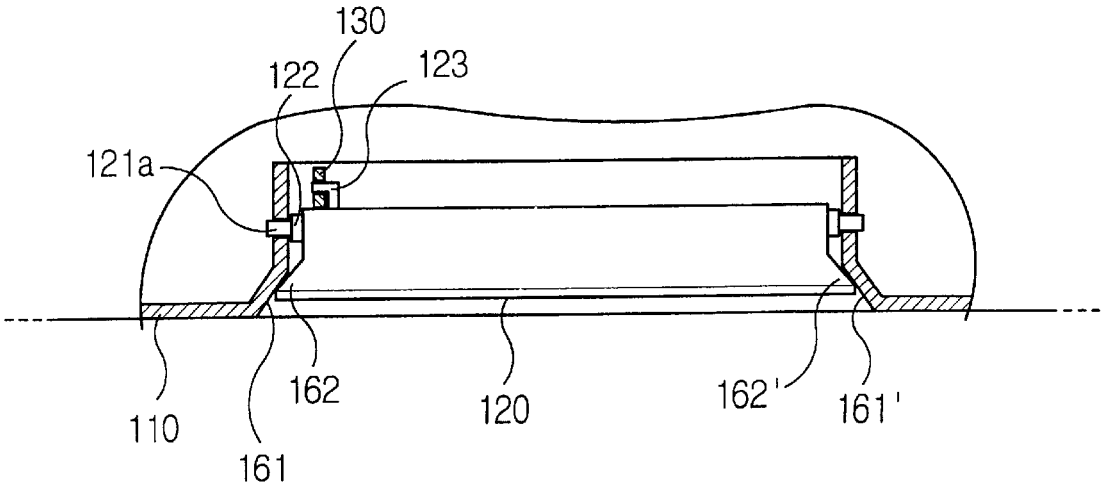
FIG. 7B is a plan sectional view of FIG. 5, in which the horizontal blades are rotated to the maximum of its rotational movement limit.

Then, as shown in FIG. 6 (in an one-dot chain line) and FIG. 7B, if the user rotates the horizontal blades 120 upward to a predetermined degree, the interference sections 162 and 162' extending from both sides of each of the horizontal blades 120 and the inclined sections 161 and 161' of the frame 110 interfere with each other, and accordingly, the horizontal blades 120 are not rotated further. Likewise, when the horizontal blades 120 are rotated downward, the degree of rotational movement of the horizontal blades 120 is limited as described above. Here, the limit of rotational movement of the horizontal blades 120 may be adjusted in accordance with the distance between the inclined sections 161 and 161' and the interference sections 162 and 162', and the degree of inclination of the inclined sections 161 and 161'.

Further, when the horizontal blades 120 are on a horizontal plane, the clearances defined between the horizontal blades 120 and both inner sidewalls of the frame 110, respectively, are covered by the interference sections 162 and 162' which extend from sides of the horizontal blades 120. As a result, the appearance of the air conditioner becomes neater.

Meanwhile, as shown in FIG. 5, the inclined sections 161 and 161' may be formed on both sides of the frame 110 while the interference sections 162 and 162' are formed on both sides of each of the horizontal blades 120. Also, the inclined sections 161 and 161' may be formed on one side of the frame 110 while the interference sections 162 and 162' are formed on one side of each of the horizontal blades 120. Particularly when the vertical connector 130 is employed as shown in FIG. 5, then the interference sections 162 and 162' may be formed on only one of the horizontal blades 120.

Figure 8:
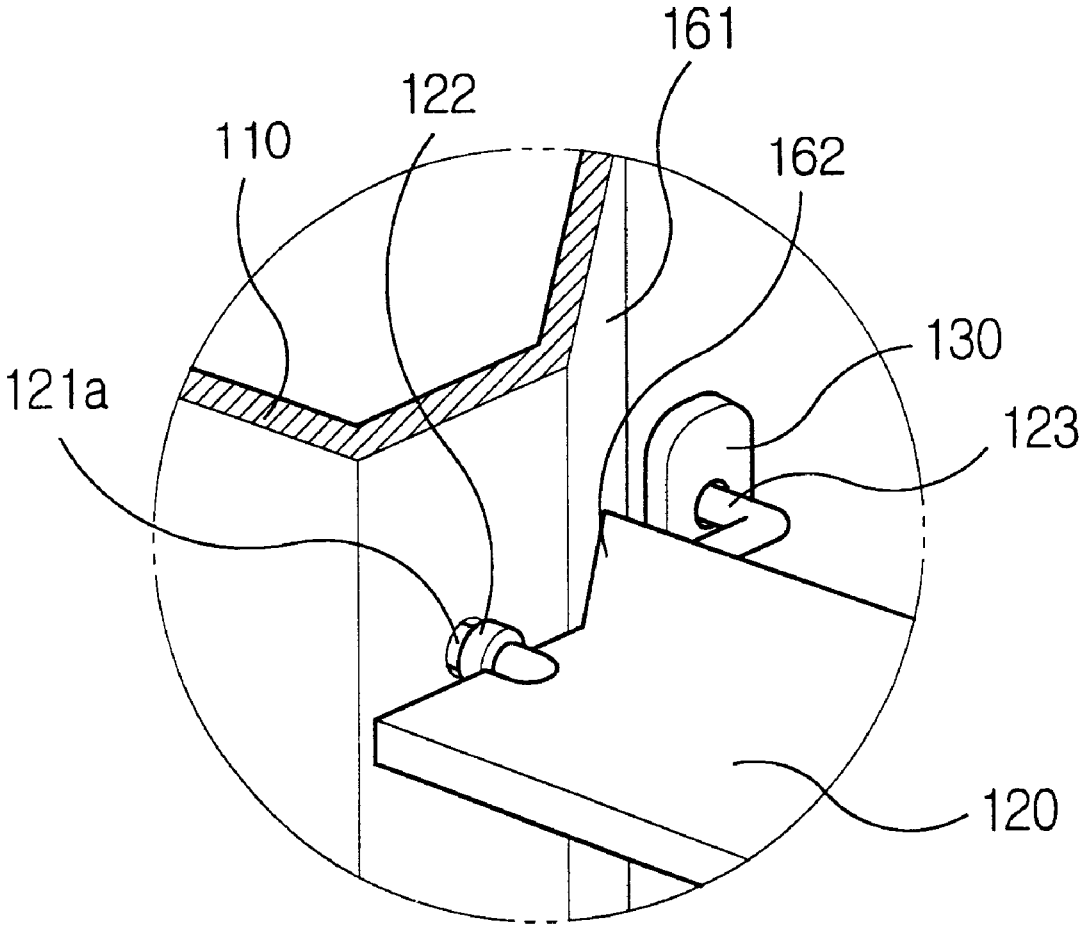
FIG. 8 is a perspective view showing the main part of the discharge grill according to a second preferred embodiment of the present invention.
Figure 9A:
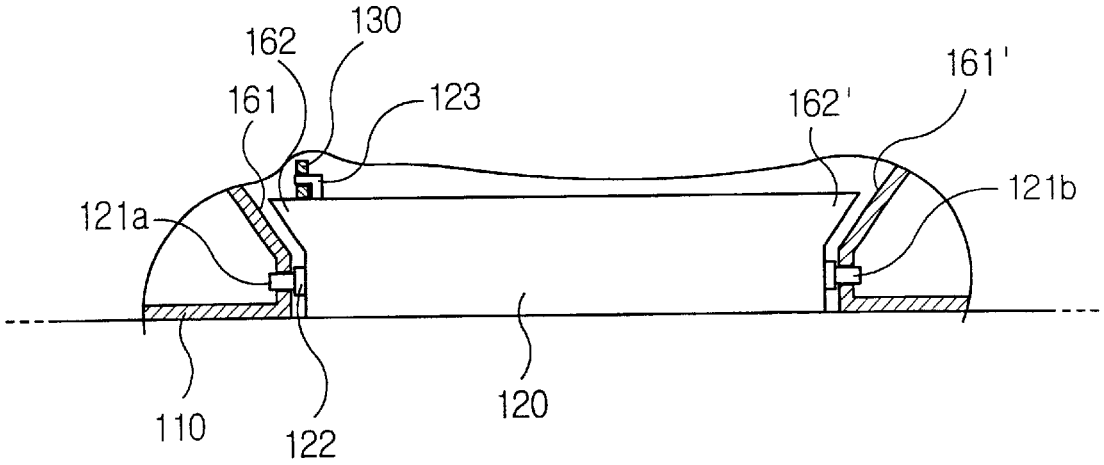
FIG. 9A is a plan sectional view of FIG. 8, in which the horizontal blades are on a horizontal plane.
Figure 9B:
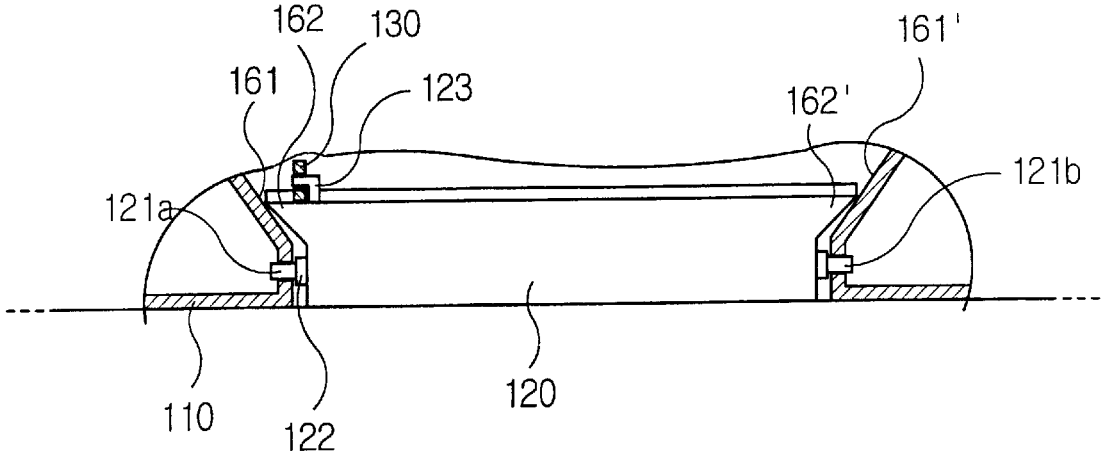
FIG. 9B is a plan sectional view of FIG. 8, in which the horizontal blades are rotated to the maximum of its rotational movement limit.

Further, the discharge grill according to the second preferred embodiment of the present invention can be modified and changed as shown in FIGS. 8 to 9B.

As shown in the figures, the rotary shafts 121*a* and 121*b* protrude from the middle portions of both sides of each of the horizontal blades 120, and the interference sections 162 and 162' are formed at the rear portions of both sides of each of the horizontal blades 120. The inclined sections 161 and 161' are formed on the frame 110 in a perpendicular relation to the upper/lower walls of the frame 110, to correspond with the interference sections 162 and 162'. Except for the rotary shafts 121*a* and 121*b*, the interference sections 162 and 162', and the inclined sections 161 and 161', the construction of the discharge grill according to the second embodiment is almost same with that of the discharge grill according to the first preferred embodiment of the present invention. Thus, additional description of the construction will be omitted, and the like elements will be given the same reference numerals.

In the discharge grill according to the second preferred embodiment of the present invention, when the horizontal blades 120 are rotated, the upward/downward rotational movement of the horizontal blades 120 is limited by the interference of the interference sections 162 and 162' of the horizontal blades 120 with the inclined sections 161 and 161' of the frame 110. Here, unlike the first preferred embodiment of the present invention, the clearances (between both sides of the horizontal blades 120 and both sidewalls of the frame 110) are not covered by the interference sections 162 and 162', because the interference sections 162 and 162' according to the second preferred embodiment of the present invention are formed at the rear portions of both sides of each of the horizontal blades 120. Accordingly, for those who are appearance-conscious, the discharge grill according to the first preferred embodiment of the present invention will be more preferable.

As described above, according to the discharge grill of the present invention, the simple variation of the horizontal blades in shapes can limit the rotational movement of the horizontal blades, without requiring separate devices therefor.

Further, according to the discharge grill of the present invention, when the interference sections 162 and 162' are formed at front portions of both sides of each of the horizontal blades 120, the interference sections 162 and 162' cover the clearances which are defined between the horizontal blades 120 and both sidewalls of the frame 110, so that the appearance of the air conditioner is improved.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A discharge grill of an air conditioner comprising:

a frame to be fixed into a discharge port of the air conditioner;

a first means for adjusting a direction of an air which is discharged from the air conditioner, in rightward/leftward direction, the rightward/leftward air direction adjusting means comprising a plurality of vertical blades which are disposed on the frame in a perpendicular relation to upper/lower walls of the frame to be rotated rightward/leftward;

a second means for adjusting the discharge direction of the air in upward/downward direction, the upward/downward air direction adjusting means comprising a plurality of horizontal blades which are disposed on the frame in a horizontal relation to the upper/lower walls of the frame to be rotated upward/downward; and a means for limiting the rotational movement of the horizontal blades at the time when the horizontal blades are rotated upward/downward, the rotational movement limiting means having an inclined section which is formed on at least one sidewall of the frame in a perpendicular relation to the upper/lower walls of the frame, and an interference section extending from the horizontal blades to correspond with the inclined section of the frame, the interference section for stopping the rotational movement of the horizontal blades by coming to an intervening position with the inclined section when the horizontal blades are rotated upward/downward to a predetermined degree.

2. The discharge grill as claimed in claim 1, wherein the inclined section is formed at both sidewalls of the frame, and the interference section is formed at both sides of the horizontal blades.

3. The discharge grill as claimed in claim 1, wherein the upward/downward air direction adjusting means further comprises a vertical connector to which the horizontal blades are connected, and the vertical connector permits the simultaneous rotation of the horizontal blades.

4. The discharge grill as claimed in claim 3, wherein the inclined section is formed at both sidewalls of the frame, and the interference section is formed at both sides of one horizontal blade of the horizontal blades.

5. The discharge grill as claimed in claim 3, wherein the inclined section is formed at both sidewalls of the frame, and the interference section is formed at sides of all the horizontal blades.

* * * * *